US007955240B2

(12) United States Patent
Nadim

(10) Patent No.: US 7,955,240 B2
(45) Date of Patent: Jun. 7, 2011

(54) EXERCISE DEVICE AND METHOD OF USING SAME

(76) Inventor: Yasser Nadim, Somerset, KY (US)

( * ) Notice: Subject to any disclaimer, the term of this patent is extended or adjusted under 35 U.S.C. 154(b) by 25 days.

(21) Appl. No.: 12/729,031

(22) Filed: Mar. 22, 2010

(65) Prior Publication Data

US 2010/0317497 A1 Dec. 16, 2010

Related U.S. Application Data

(60) Provisional application No. 61/305,748, filed on Feb. 18, 2010, provisional application No. 61/268,445, filed on Jun. 12, 2009.

(51) Int. Cl.
*A63B 22/16* (2006.01)
*A63B 22/00* (2006.01)
*A63B 69/18* (2006.01)

(52) U.S. Cl. ..... 482/146; 482/51; 482/70

(58) Field of Classification Search ..... 482/146–147, 482/132, 135, 136, 70–70, 51, 140
See application file for complete search history.

(56) References Cited

U.S. PATENT DOCUMENTS 3,834,693 A * 9/1974 Poppenberger ..... 482/71
3,911,907 A * 10/1975 Smith, Jr. ..... 482/1
3,936,047 A 2/1976 Brandt et al.
4,200,282 A * 4/1980 Agyagos ..... 482/147
4,305,579 A * 12/1981 Rice ..... 482/147
4,319,749 A * 3/1982 Agyagos ..... 482/147
4,390,180 A 6/1983 Simjian
4,396,189 A 8/1983 Jenkins
4,625,962 A * 12/1986 Street ..... 482/116
4,629,181 A * 12/1986 Krive ..... 482/71
4,743,015 A * 5/1988 Marshall ..... 482/70
4,930,771 A 6/1990 Wilson
4,961,574 A * 10/1990 Lew ..... 472/17
5,147,257 A * 9/1992 Loane ..... 482/71
5,192,258 A * 3/1993 Keller ..... 482/71
5,232,423 A * 8/1993 Hajduczek ..... 482/68
5,242,340 A * 9/1993 Jerome ..... 482/52
5,503,609 A * 4/1996 Bull ..... 482/70
5,575,740 A * 11/1996 Piaget et al. ..... 482/70
5,582,567 A * 12/1996 Chang ..... 482/146
5,632,711 A * 5/1997 Hwang ..... 482/147

(Continued)

OTHER PUBLICATIONS abGlider—http://proform.com.

(Continued)

*Primary Examiner* — Steve R Crow
(74) *Attorney, Agent, or Firm* — Stoll Keenon Ogden, PLLC; Rebecca Ann Krefft

(57) ABSTRACT

An exercise device including a frame including a base frame and first and second posts extending substantially orthogonally from substantially outer ends of the base frame, a first platform rotatably connected to the base frame and selectably lockable in at least one position. The first platform includes a curved track mounted on the first platform such that a lowest point of the curved track is substantially near a center of the first platform and a pair of high points are located substantially near opposite outer edges of the first platform. A rolling mechanism is configured to ride on the curved track. A second platform rotatably mounted to the rolling mechanism is selectably lockable in at least one position. Such an exercise device provides multiple ranges of motion designed to provide an abdominal exercise that targets various different abdominal muscle regions, and may also provide an aerobic and/or cardiac workout.

13 Claims, 11 Drawing Sheets

U.S. PATENT DOCUMENTS 5,711,749 A 1/1998 Miller
5,879,275 A * 3/1999 Aruin ..... 482/146
6,196,954 B1 * 3/2001 Chen ..... 482/131
6,210,305 B1 * 4/2001 Eschenbach ..... 482/52
6,220,991 B1 * 4/2001 Sellers ..... 482/62
6,244,995 B1 * 6/2001 Prsala ..... 482/96
6,669,610 B2 12/2003 Slowinski
6,689,019 B2 * 2/2004 Ohrt et al. ..... 482/52
6,740,011 B1 * 5/2004 Tsai et al. ..... 482/80
6,875,159 B2 * 4/2005 Chuang ..... 482/51
7,014,595 B2 * 3/2006 Bruno ..... 482/51
7,081,074 B1 * 7/2006 Rubin ..... 482/146
7,104,928 B1 * 9/2006 Liu et al. ..... 482/52
7,121,981 B2 * 10/2006 Whitall et al. ..... 482/8
7,303,508 B2 12/2007 Toyama et al.
7,341,542 B2 * 3/2008 Ohrt et al. ..... 482/52
7,438,675 B2 10/2008 Lin
7,455,633 B2 11/2008 Brown et al.
7,473,210 B1 * 1/2009 Hsiung ..... 482/51
7,485,079 B2 2/2009 Brown et al.
7,559,882 B2 7/2009 Chou
D598,965 S 8/2009 Augustine et al.
7,582,043 B2 * 9/2009 Liao et al. ..... 482/52
7,585,263 B2 * 9/2009 Brown et al. ..... 482/142
7,611,445 B2 * 11/2009 Brown et al. ..... 482/51
7,632,219 B2 * 12/2009 Ohrt et al. ..... 482/52
7,654,936 B2 * 2/2010 Liao et al. ..... 482/52
7,753,831 B2 * 7/2010 Langer et al. ..... 482/146
7,775,950 B2 * 8/2010 Campanaro et al. ..... 482/130
7,775,953 B2 * 8/2010 Wang ..... 482/147
2002/0177511 A1 11/2002 Jang
2004/0242381 A1 * 12/2004 Parmater ..... 482/71
2007/0259760 A1 11/2007 Perez
2008/0020915 A1 * 1/2008 Pacheco et al. ..... 482/146
2008/0064577 A1 * 3/2008 Pederson et al. ..... 482/140
2008/0161173 A1 * 7/2008 Campanaro et al. ..... 482/133
2008/0161175 A1 * 7/2008 Ho ..... 482/146
2009/0105050 A1 * 4/2009 Mayo ..... 482/70
2009/0124472 A1 5/2009 Chou
2009/0163337 A1 * 6/2009 Petrakov ..... 482/147
2009/0176631 A1 * 7/2009 Blessing ..... 482/71
2009/0186746 A1 * 7/2009 Pandolfo ..... 482/7
2009/0227426 A1 * 9/2009 Dubar ..... 482/34
2010/0087302 A1 * 4/2010 Fukunaga ..... 482/146
2010/0093497 A1 * 4/2010 Kuo ..... 482/52
2010/0099542 A1 * 4/2010 Fernandez et al. ..... 482/142
2010/0227748 A1 * 9/2010 Campanaro et al. ..... 482/140

OTHER PUBLICATIONS

AbFlyer—http://abflyer.com.

* cited by examiner

EXERCISE DEVICE AND METHOD OF USING SAME

CROSS REFERENCE TO RELATED APPLICATION

This application claims priority under 35 U.S.C. §119(e) to U.S. Provisional Application No. 61/268,445, filed Jun. 12, 2009, and U.S. Provisional Application No. 61/305,748, filed Feb. 18, 2010, each of which is incorporated by reference herein in its entirety.

FIELD OF THE INVENTION

The present invention relates to an abdominal exercise device, which in an embodiment includes double circular platforms with a curved track located therein for providing multiple training options and difficulties.

BACKGROUND OF THE INVENTION

It is desirable for an abdominal exercise device to provide a user with more than one type of movement in order to exercise abdominal and other muscles. Prior to the existence of abdominal exercise devices, a person would perform a variety of different types of exercises in order to develop his/her abdominal muscles. For example, a user performing sit-ups or crunches may work the muscles of the abdomen.

Different exercise machines have been designed to help building and strengthening the abdominal muscles and also to help the user to lose abdominal fat. In order to develop a system that build and strengthen the abdominal muscles, basic knowledge about the abdominal group of muscles is needed (anatomy, site of origin, site of insertion, mechanism of action, and direction of contracture for each of the muscles which constitute part of the abdominal wall).

Most abdominal exercise machines focus on one group of muscle in the abdominal wall. The attention of these exercise machines is brought to either the rectus abdominus muscle, which is the muscle in the front of the abdomen, or the side muscle of the abdominal wall (external and internal oblique muscles).

A shortcoming of these devices is that they are typically limited in their focus to particular abdominal muscles, are limited in their range of motion causing a "one-size fits all" type of exercise device, and may require the user to use the device in a body position that is uncomfortable or impractical for certain body types. In addition, these devices may not provide for the ability to increase the resistance or range of motion to permit a wide-range of users of varying strengths, body types, and fitness levels to use the exercise device. Such exercise devices may also lack the ability to simultaneously provide an aerobic and/or cardiac training function.

A desirable feature of an abdominal exercise device provides for more than a single type of movement (e.g., lateral, longitudinal, pivotal, etc.) of the user's body in order to provide a wide variety of abdominal exercises. Additional features and objects of the invention are described further below.

SUMMARY OF THE INVENTION

In an embodiment of the invention, an exercise device comprises a base, a first selectably rotatable platform, a curved track mounted on the first platform, a rolling mechanism designed and configured to ride on the curved track, and a second selectably rotatable platform mounted to the rolling mechanism. Such an exercise device provides multiple ranges of motion designed to provide an abdominal exercise that targets various different abdominal muscle regions, and may also provide an aerobic and/or cardiac workout.

Thus, by selectively locking the first and/or second platforms or the rolling mechanism, a user can achieve a desired workout that targets selected muscle groups. For instance, by locking the first platform in a first position that positions the track to extend in front of and behind a user, and further locking the second platform, the user can be provided with a front to back movement along the curved track. Alternatively, by locking the first platform in a second position that positions the track to extend to the left and right of a user, and further locking the second platform, the user can be provided with a side to side movement along the curved track. It is envisioned that the exercise device will include, but not be required to have, at least the two above-described locking positions, but preferably will include a number of intervening locking positions such that the track may be positioned at angles between the front to back and side to side positions to further provide flexibility in the muscle targeting training regimen.

Further, by locking the rolling mechanism in a selected position on the track away from the center, and unlocking the second and first platform, a rotational range of motion about an axis passing through the center of the first platform can be achieved.

Further, by locking the first platform in one of the locking positions, and further locking the rolling mechanism in a selected position on the track, and unlocking the second platform, a rotational range of motion can be achieved. Similarly, by locking the rolling mechanism in a selected position on the track away from the center, and locking the second platform, but unlocking the first platform, a rotational range of motion about an axis passing through the center of the first platform can be achieved.

Turning back to a summary description of the exercise device, by way of summary, and not limitation, an exercise device generally comprises a base frame including at least one beam. First and second posts are each fixed to a respective end of the beam and extend upward from the beam in a substantially orthogonal manner. A top end of each of the first and second posts includes an inwardly extending extension, which has an arm rest portion at an end thereof. The extensions each preferably have a slight incline relative to the first and second posts, such that an angle between the extensions and the posts is obtuse.

A platform, which is preferably circular, but may be generally oblong or elliptical in shape, and has upper and lower surfaces, is rotatably mounted to the beam of the base frame. The platform may rotate about a first axis perpendicular to a plane of the beam of the base frame. In an embodiment, the connection between the lower surface of the platform and the base frame is made via a turntable, which may include two movable sections (the first attached to the base frame and the second attached to the lower surface of the platform) separated by a low friction surface, such as may be produced by ball bearings. A first locking device may be included to prevent the platform from rotating on the base frame.

A track is mounted to the upper surface of the platform. The track generally comprises a pair of curved track portions, which extend away from the upper surface of the platform such that the curved surface of the track portions faces away from the platform. The track portions can be attached to one another by a pair of cross-braces mounted at each end of the respective track portions. In a preferred embodiment, an inner surface of each track portion preferably includes a channel that substantially follows the curve of the track portions. The channels preferably terminate at a distance away from the end of the track portions to limit the range of motion within the track portion, as will be described in further detail below.

A second platform includes a rolling mechanism rotatably mounted to a bottom surface of the second platform. In an embodiment, the connection between the bottom surface of the second platform and the rolling mechanism is made via a turntable, which may include two movable sections (the first attached to the rolling mechanism and the second attached to the bottom surface of the second platform) separated by a low friction surface, such as may be produced by ball bearings. A second locking device may be included to prevent the second platform from rotating relative to the rolling mechanism.

The rolling mechanism generally comprises two pairs of wheels each mounted on an axle, which is in turn mounted to a frame of the rolling mechanism. The wheels are spaced such that, when the rolling mechanism is positioned on the curved surfaces of the track portion, the wheels will ride on the curved surfaces. The upper surface of the frame of the rolling mechanism is mounted to the turntable that mounts to the second platform for providing the rotational functionality of the second platform. A pair of downwardly extending fins extend from a bottom surface of the frame of the rolling mechanism, and are preferably positioned to extend downward and into the space between the inside walls of the track portions when the rolling mechanism is positioned on the track. In an embodiment, at least one channel engagement portion preferably extends from an outside face of each of the fins. Each channel engagement portion can be sized and configured to slidably engage the channels of the respective track portions, such that when the rolling mechanism is riding on the curved surfaces of the track portions the channel engagement portions will move within the channels to provide lateral support to the rolling mechanism. Multiple channel engagement portions may be provided on the fins to increase lateral support and prevent the rolling mechanism from falling off of the track. In an embodiment, a third locking device can lock the rolling mechanism, and thus the second platform, is a specified position on the track.

Additional features and advantages of the present invention are described further below. This summary section is meant merely to illustrate certain features of the invention, and is not meant to limit the scope of the invention in any way. The failure to discuss a specific feature or embodiment of the invention, or the inclusion of one or more features in this summary section, should not be construed to limit the invention as claimed.

BRIEF DESCRIPTION OF THE DRAWINGS

The foregoing summary, as well as the following detailed description of preferred embodiments of the application, will be better understood when read in conjunction with the appended drawings. The drawings and embodiments described within this specification are to be understood as illustrative and exemplary of structures, features and aspects of the present invention and not as limiting the scope of the invention. It should be understood that the application is not limited to the precise arrangements and instrumentalities shown. In the drawings.

DETAILED DESCRIPTION OF THE INVENTION

Figure 1:
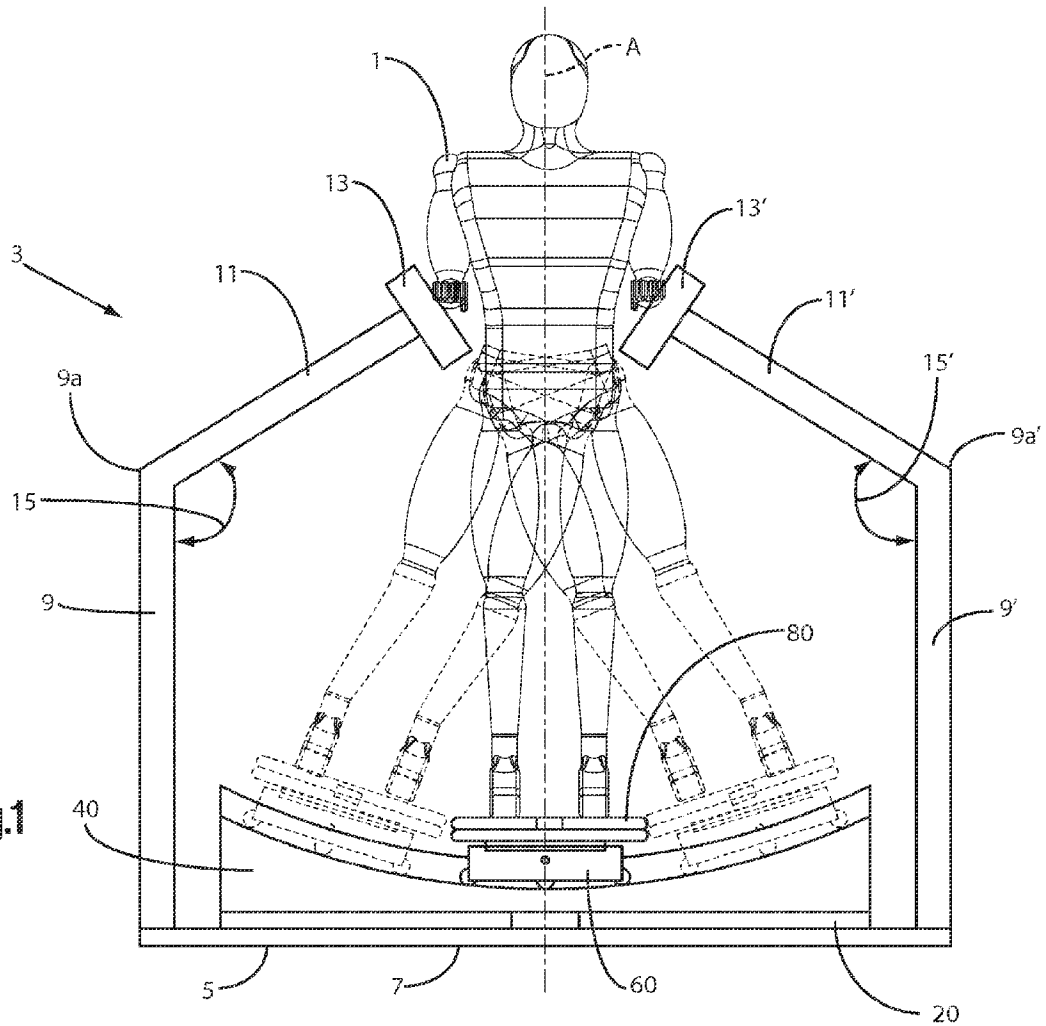
FIG. 1 is a schematic illustration of a front view of an exercise device in accordance with an embodiment of the present invention.

The methods and embodiments described within this specification are to be understood as illustrative and exemplary of the composition, structures, features and aspects of the present invention and not as limiting the scope of the invention. Certain terminology is used in the following description for convenience only and is not limiting. The words "right", "left", "top" and "bottom" designate directions in the drawings to which reference is made. The words "inwardly" and "outwardly" refer to directions toward and away from, respectively, the geometric center of the device and designated parts thereof. The words, "anterior", "posterior", "superior", "inferior", "lateral" and related words and/or phrases designate preferred positions and orientations in the human body to which reference is made and are not meant to be limiting. The terminology includes the above-listed words, derivatives thereof and words of similar import.

Referring now collectively to the Figures, in the various embodiments of the invention, an exercise device 3 provides multiple ranges of motion designed to provide an abdominal exercise that targets various different abdominal muscle regions, and may also provide an aerobic and/or cardiac workout. In a preferred embodiment, the exercise device 3 includes at least two selectably rotatable platforms 20, 80 wherein the second rotatable platform rides on a selectably lockable rolling mechanism 60. The rolling mechanism rides on a curved track 40 mounted on the first rotatable platform 20. By selectively locking the first and/or second platforms 20, 80 or the rolling mechanism 60, a user can achieve a desired workout that targets selected muscle groups.

Figure 2:
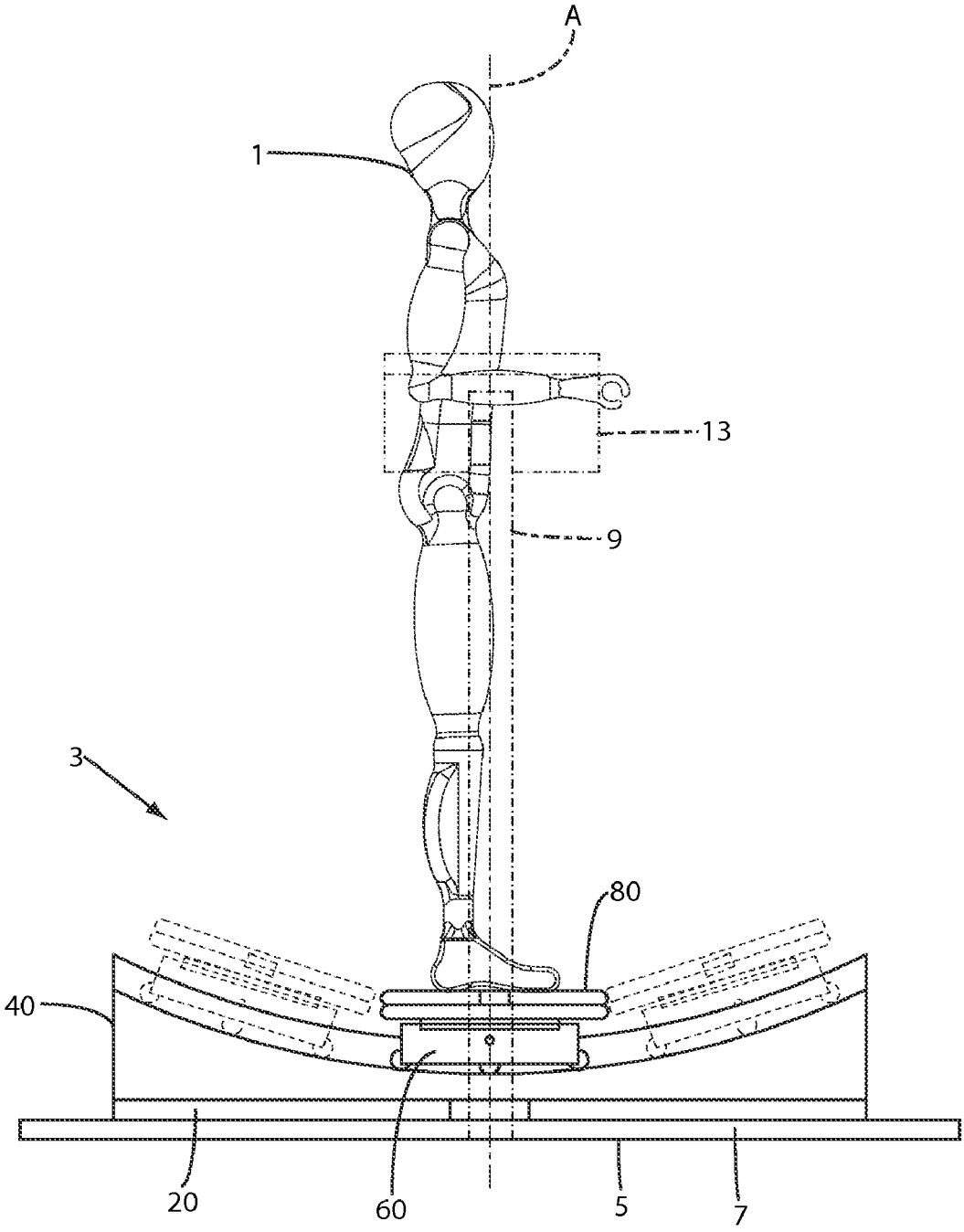
FIG. 2 is a schematic illustration of a side view of the exercise device of FIG. 1 in accordance with an embodiment of the present invention.

For instance, as shown in FIG. 2, by locking the first platform 20 in a first position that positions the track 40 to extend in front of and behind a user 1, and further locking the second platform 80, the user 1 can be provided with a front to back movement along the curved track 40. This exercise is intended to target the anterior abdominal muscles as well as the back muscles (the rectus abdominus muscle which is attached between the pubis and the cartilage of 5th, 6th and 7th ribs having the function of bringing the rib cage and the pelvis toward each other during the forward part of the exercise, and the erector spinae muscles working in the backward part of the movement.

Figure 1A:
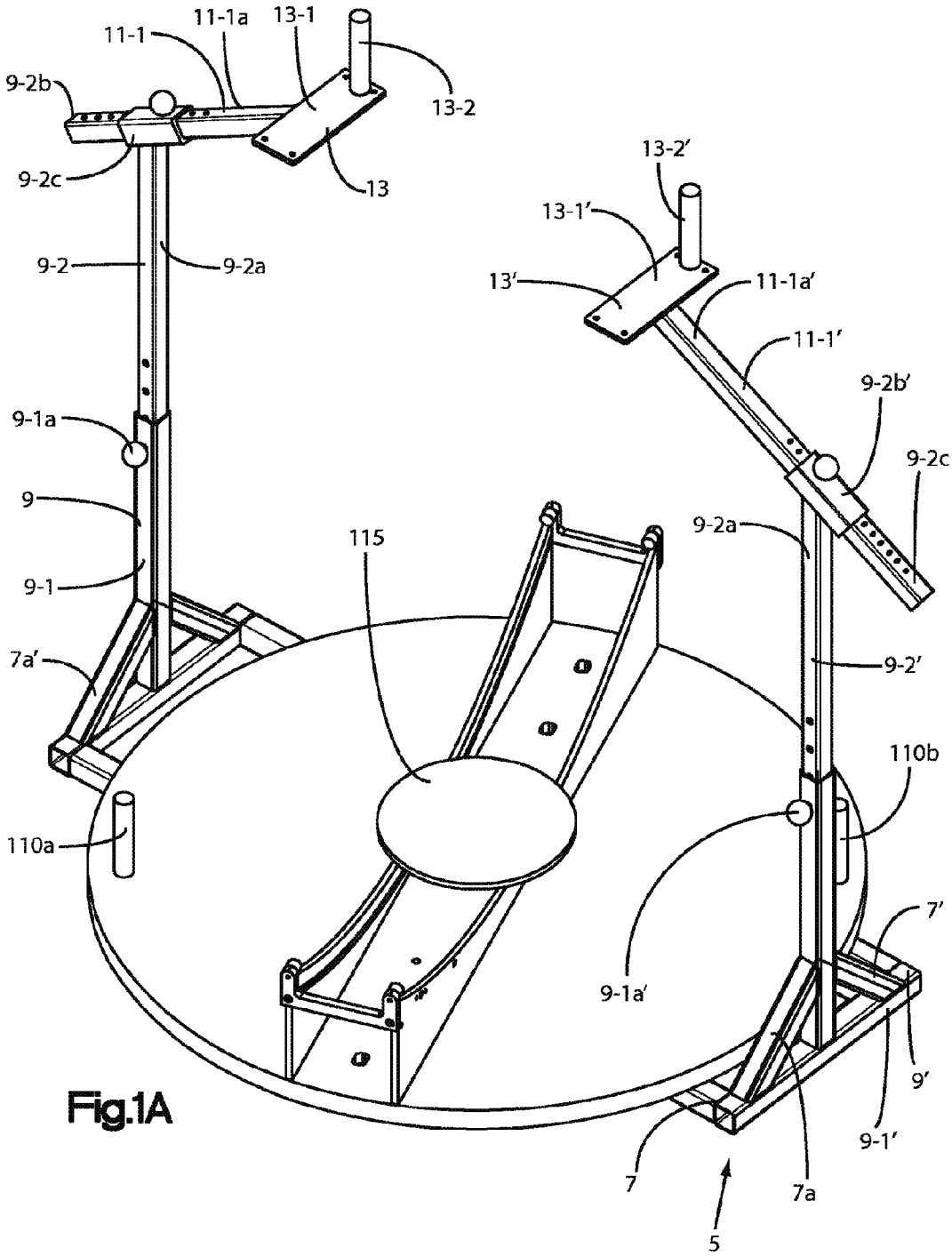
FIGS. 1A and 1B are schematic illustrations of an isometric view of the exercise device of FIG. 1 in accordance with an embodiment of the present invention.

Alternatively, as shown in FIGS. 1 and 1A, by locking the first platform 20 in a second position that positions the track 40 to extend to the left and right of a user 1, and further locking the second platform 80, the user 1 can be provided with a side to side movement along the curved track 40. This exercise is intended to target the lateral part of the abdominal wall, the external oblique, the internal oblique and the transversus abdominus muscles. The external oblique is situated on the lateral and anterior part of the abdomen. It arises from the 5th to 12th ribs. The lower fibers pass vertically downward and are inserted into the anterior half of the outer iliac crest, the middle and upper fibers are directed downward and forward, then become aponeurotic. This aponeurosis formed from fibers from either side decussate at the linea alba. The internal oblique fibers run perpendicular to external oblique muscles. It arises from the thoraco lumbar fascia in the back and anterior two third of the iliac crest and the lateral half of the inguinal ligament. Its fibers run into a superior and medial direction toward the midline and gets attached to the linea alba and the 10th through 12th ribs. External and internal oblique muscles rotate and side bend the trunk. The external oblique of one side acts with the internal oblique of the other side to achieve torsional movement of the trunk.

It is envisioned that the exercise device 3 will include, but not be required to have, at least the two above-described locking positions, but preferably will include a number of intervening locking positions such that the track 40 may be positioned at angles between the front to back and side to side positions to further provide flexibility in the muscle targeting training regimen. It will also be understood by persons of skill in the art that the discussion of what muscles are intended to be targeted by the exercise device 3 is not meant to be limiting and whether such muscles are actually impacted and to what degree depends not only on the operation of the device, but also on proper usage by a user of said device.

Figure 3:
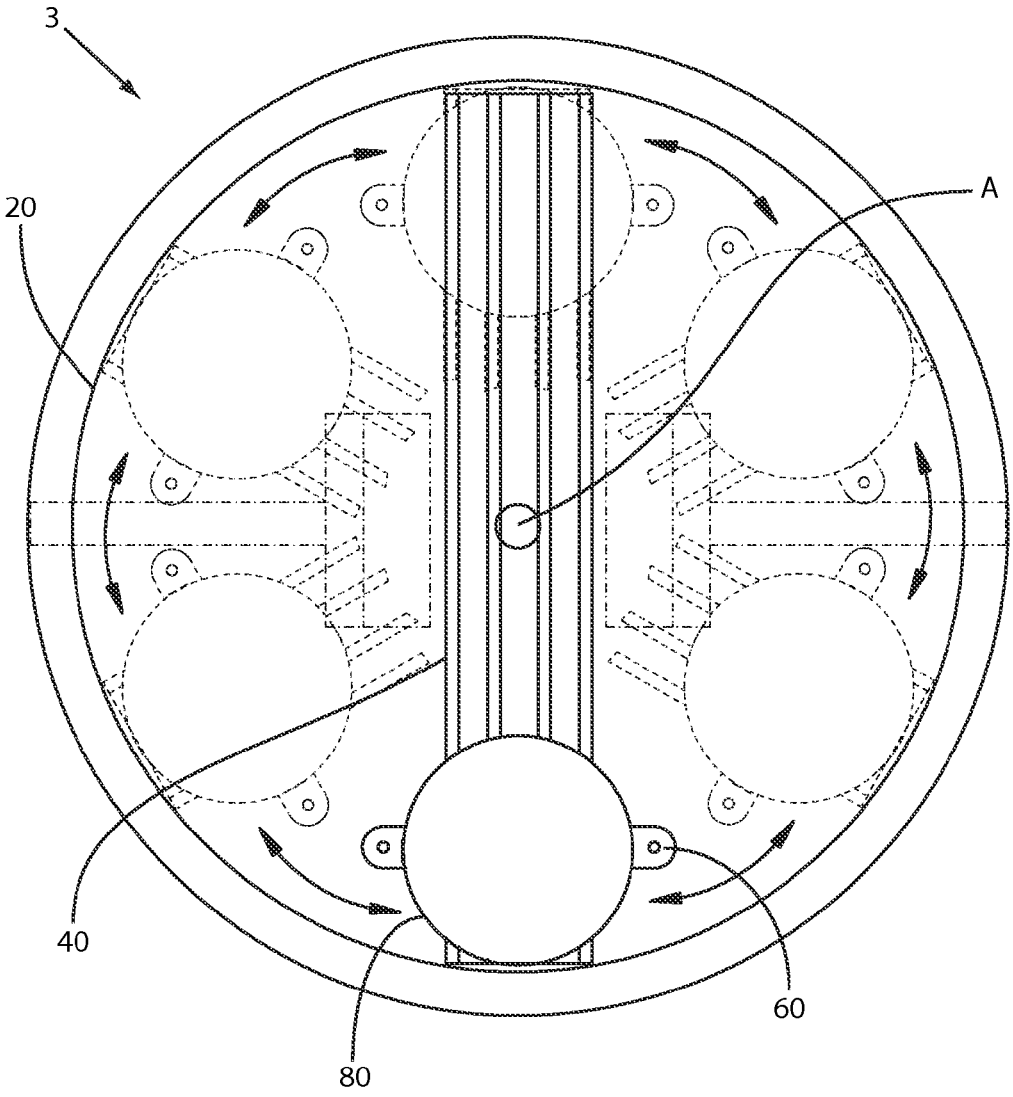
FIG. 3 schematically illustrates a top view of the second platform in a selected position of the track mounted to the first platform in accordance with an embodiment of the present invention.

As depicted in FIG. 3, a rotational range of motion about an axis A passing through the center of the first platform 20 can be achieved by unlocking the first 20 and second 80 platform, and locking the rolling mechanism 60 in a selected position on the track (which include any of the locking positions on the track 40 away from the center). The user will perform rotational movement using the whole torso muscles in one block around the center of the machine. Further, the first platform can be configured with a resistance mechanism that may include a weight holding device or a mean to resist the twisting of the bearings on which the first platform 20 is mounted, which will increase the intensity of the exercise performed by the torso muscles.

Further, in either of the positions shown in FIGS. 1 and 2, by locking the first platform 20 in one of the locking positions, and further locking the rolling mechanism 60 in a selected position on the track (which includes the center position or any other position on the track 40), and unlocking the second platform 80, a rotational range of motion can be achieved. In this way, for example, a user 1 would twist the core of their bodies such that their lower bodies twisted back and forth (or left and then right, or vice versa). If the rolling mechanism 60 is locked in a position outside of the center, a specific oblique muscle can be further targeted.

A similar rotational motion can be achieved by locking the second platform 80 in one of the locking positions, and further locking the rolling mechanism 60 in a selected position on the track (which includes the center position or any other position on the track 40), and unlocking the first platform 20. This differs from the aforementioned rotation, because, as shown in FIG. 1A, the first platform 20 can be configured with a resistance mechanism 110. The resistance mechanism 110 may include a weight holding device or a means to resist the twisting of the bearings on which the first platform 20 is mounted. Resistance mechanism 110, as shown in FIG. 1A is preferably formed as a pair of upwardly extending posts 110A and 110B, which are designed and configured to hold one or more platen weights on the surface of the first platform 20. The weights increase the rotational inertia of the first platform 20 making it increasingly more difficult for a user to turn the first platform and thereby increasing the effort necessary to perform the exercise. Of course, one skilled in the art will recognize that the second platform 80 can also be configured to include a resistance mechanism 115, as previously described.

As yet a further alternative, the respective resistance mechanisms of the first and second platforms 20, 80 could be a magnetic or friction based resistance mechanism applied to the rotational motion of the turntables 24, 62 that permit rotation of the first and second platforms 20, 80.

As depicted in FIG. 3, by locking the rolling mechanism 60 in a selected position on the track 40 away from the center, and locking the second platform 80, but unlocking the first platform 20, a rotational range of motion about an axis A passing through the center of the first platform 20 can be achieved.

Figure 1B:
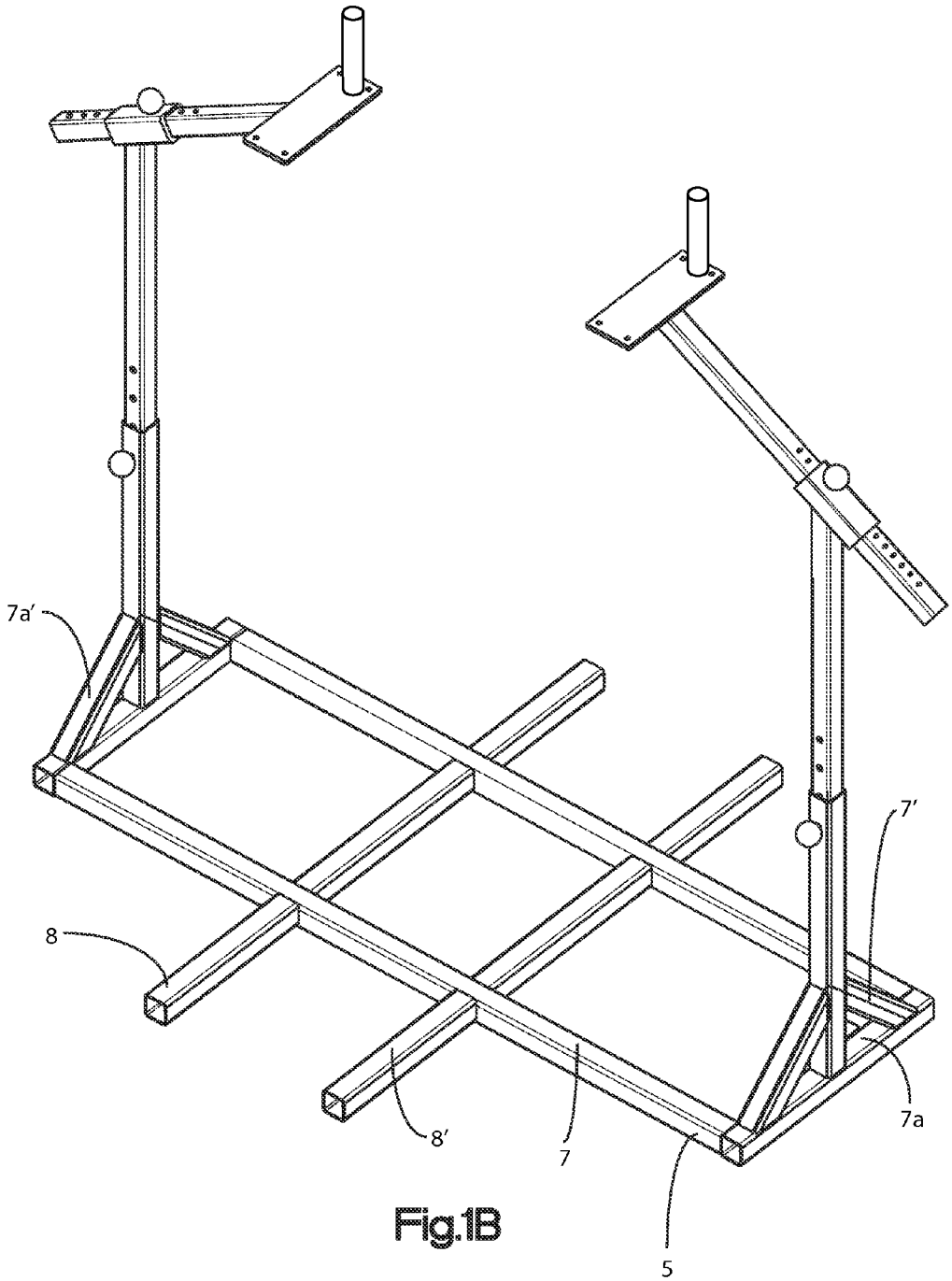
Figure 1C:
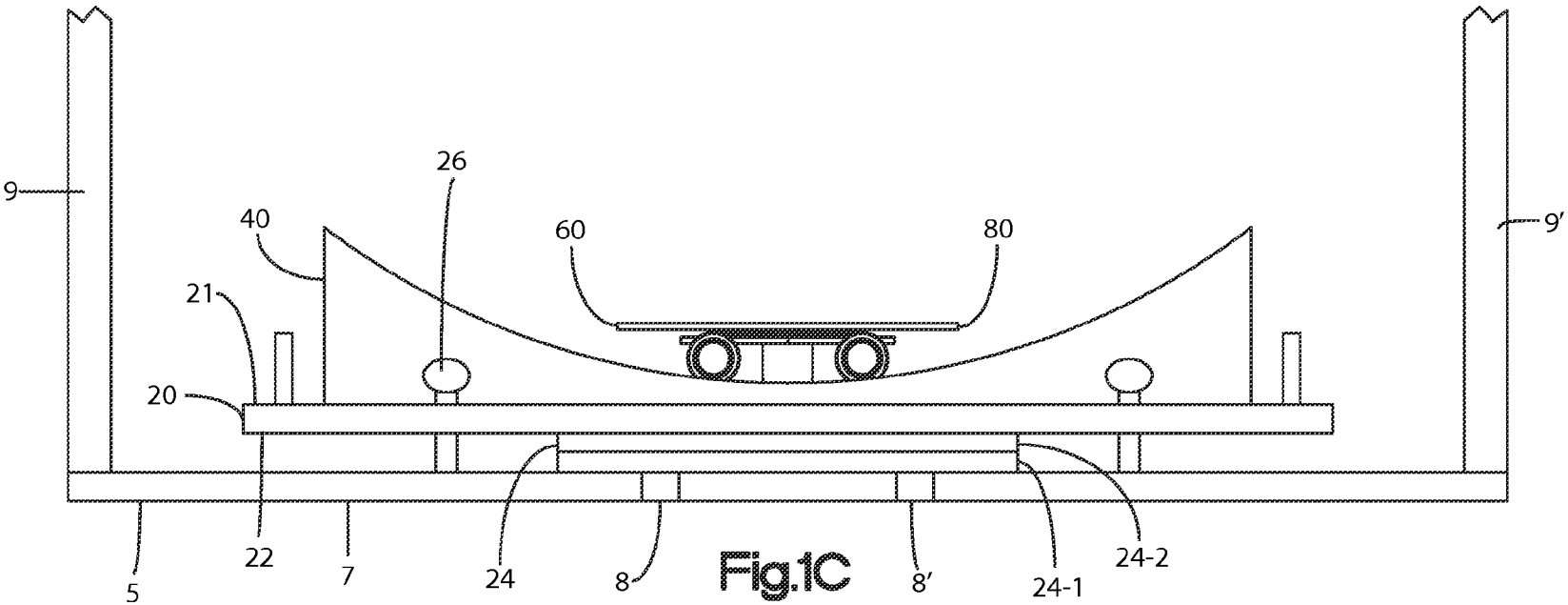
FIGS. 1C-1D are schematics showing various features of the exercise device of FIG. 1 in accordance with an embodiment of the present invention.

With reference again to FIGS. 1 and 2, an exemplary embodiment of an exercise device 3 comprises a base 5, a first selectably rotatable platform 20, a curved track 40 mounted on the first platform 20, a rolling mechanism 60 designed and configured to ride on the curved track 40, and a second selectably rotatable platform 80 mounted to the rolling mechanism 60. In the embodiment shown in FIG. 1, the base frame 5 includes at least one beam 7. In a preferred embodiment of base frame 5, as shown in FIG. 1B, beams 7 and 7' extend substantially parallel to one another and are joined together at each end thereof by braces 7*a* and 7*a*'. By way of non-limiting example, the length of beams 7, 7' is 140 cm (~55 inches) and the length of braces 7*a*, 7*a*' is 20 cm (7.87 inches). In addition, as further shown in FIG. 1B, a pair of cross-beams 8 and 8' may be included to further stabilize the base frame 5 to support the weight and twisting motion of the user above. To keep the cross-beams 8, 8' out of sight, if a circular first platform 20 is used, the length of cross-beams 8, 8' can be approximately 100 cm (39.37 inches). Persons of skill in the art will recognize that the base frame 5 may be constructed in a number of ways designed and configured to adequately support even an extreme weight for a person using the device 3. For example, a larger rectangle shape made of two beams 7, 7' and two braces 7*a*, 7*a*' with one or more optional cross-braces 8, 8' could be used. A generally square or circular shape could be used, as well a triangular shape.

It is preferred that the components of the base frame 5 are constructed from tubular steel. By way of non-limiting example, the tubular steel is 1.5"×1.5" square tubing. 2"×2" may also be used to increase the strength and stability of the base frame 5, but weight may then be a concern. Persons of skill in the art will recognize that other materials providing adequate strength and stability could also be used, such as, for example, carbon fiber products, plastics, other metals, and graphite to name a few. The components are also preferably seam welded together, but may be fastened in any manner known in the art, such as, for example, through use of glue, screws, rivets. Alternatively, the components may be integrally formed.

With reference again to FIGS. 1, 1A, and 2, first and second posts 9, 9' are each fixed to a respective end of the base frame 5, preferably at the position of the braces 7*a*, 7*a*', and extend upward from the frame 5 in a manner substantially orthogonal to the plane of the frame 5. A top end 9*a*, 9*a*' of each of the first and second posts 9, 9' includes an inwardly extending extension 11, 11', which has an arm rest portion 13, 13' at an end thereof. The extensions 11, 11' each preferably have a slight incline relative to the first and second posts, such that an angle 15, 15' between the extensions 11, 11' and the posts 9, 9' is obtuse.

In a preferred embodiment, as shown in FIG. 1A, posts 9, 9' and extensions 11, 11' are constructed of three main parts: a base post section 9-1, 9-1'; an upper post section 9-2, 9-2'; and an extension section 11-1, 11-1'. In the preferred embodiment being described, base post section 9-1, 9-1' is formed of a hollow tube structure. The cross-section of such tube structure may be generally square in shape, although other shapes may be used. As with base frame 5, 1.5"×1.5" tube steel can be used to form base post section 9-1, 9-1'. The hollow space of base post section 9-1, 9-1' is designed and configured to receive upper post section 9-2, 9-2' in the hollow space, so that upper post section 9-2, 9-2' may slidably move upwards and downwards at the option of the user. In a preferred embodiment, the height of base post section 9-1, 9-1' is approximately 1 meter (3.28 feet).

The upper post section 9-2, 9-2' is preferably held in place at a selectable height through use of a spring-loaded pin system. As shown in FIG. 1A, upper post section 9-2, 9-2' includes a number of holes 9-2*a*, 9-2*a*' into which a spring loaded pin 9-1*a*, 9-1*a*' positioned near a top end of the base post section 9-1, 9-1' can be inserted to at least temporarily fix the height of upper post section 9-2, 9-2' and thus the height of the arm rest portion 13, 13'. Although use of a spring loaded pin is described herein, a loose pin or other height selection components can be used in place of the spring loaded pin. In a preferred embodiment, by way of example only, the length of upper post section 9-2, 9-2' is approximately 0.75 meters (2.46 feet). Holes 9-2*a*, 9-2*a*' are preferably spaced about 5 cm (~2 inches) apart and number about twelve (12) to accommodate approximately 60 cm (or 2 feet) of adjustment.

Similarly, the extension section 11-1, 11-1' may be slidably positioned to adjust the height and separation of the arm rests 13, 13' through use of spring-loaded pin system. As shown in FIG. 1A, upper post section 9-2, 9-2' further includes a sleeve 9-2*c*, 9-2*c*' at a top end of the upper post section 9-2, 9-2'. The sleeve 9-2*b*, 9-2*b*' is preferably positioned at angle 15, 15' to produce the desired incline for extension section 11-1, 11-1', as previously described. Extension section 11-1, 11-1' includes a number of holes 11-1*a*, 11-1*a*' into which a spring loaded pin 9-2*c*, 9-2*c*' positioned on the sleeve 9-2*b*, 9-2*b*' of upper post section 9-2, 9-2' can be inserted to at least temporarily fix the position of extension section 11-1, 11-1' and thus the height and separation of the arm rest portion 13, 13'. Although use of a spring loaded pin is described herein, a loose pin or other height selection components can be used in place of the spring loaded pin. The length of extension sections 11-1, 11-1' is preferably 65 cm (~26 inches), which enables the extension section 11-1, 11-1' to compress and expand to suit numerous body types and still maintain sufficient tube length within sleeve 9-2*b*, 9-2*b*' for stability. Extension sections 11-1, 111' may have nine (9) holes each separated by 5 cm (~2 inches) to permit multiple customization of the position of arm rests 13, 13'.

As further shown in FIG. 1A, arm rest 13, 13' preferably include a flat portion 13-1, 13-1' that is positioned substantially parallel to the ground and/or the plane of the base frame 5. Arm rest 13, 13' may also include handle 13-2, 13-2' to aid the user in maintaining balance and stability on the device 3.

Referring again to FIGS. 1 and 2, a first selectably rotatable platform 20, which is preferably circular, but may be generally square, rectangular, oblong or elliptical in shape, and has upper and lower surfaces 21, 22, is rotatably mounted to the beam 7 of the base frame 5. The platform 20 may rotate about a first axis A perpendicular to a plane of the beam 7 of the base frame 5. In an embodiment, the connection between the lower surface 22 of the platform 20 and the base frame 5 is made via a turntable 24 (see FIGS. 4A and 4B), which may include two movable sections 24-1, 24-2 (the first 24-1 attached to the base frame 5 and the second 24-2 attached to the lower surface 22 of the platform 20) separated by a low friction surface (not shown), such as may be produced by ball bearings. In a preferred embodiment, platform 20 is approximately 120 cm (~47 inches); however, other dimensions may be used so long as the outer edge of platform 20 clears the first and second posts, 9, 9'. In addition, the size of platform 20 can be dictated by the desired range of motion for travel of the second platform 80 on the curved track 40.

Figure 1D:
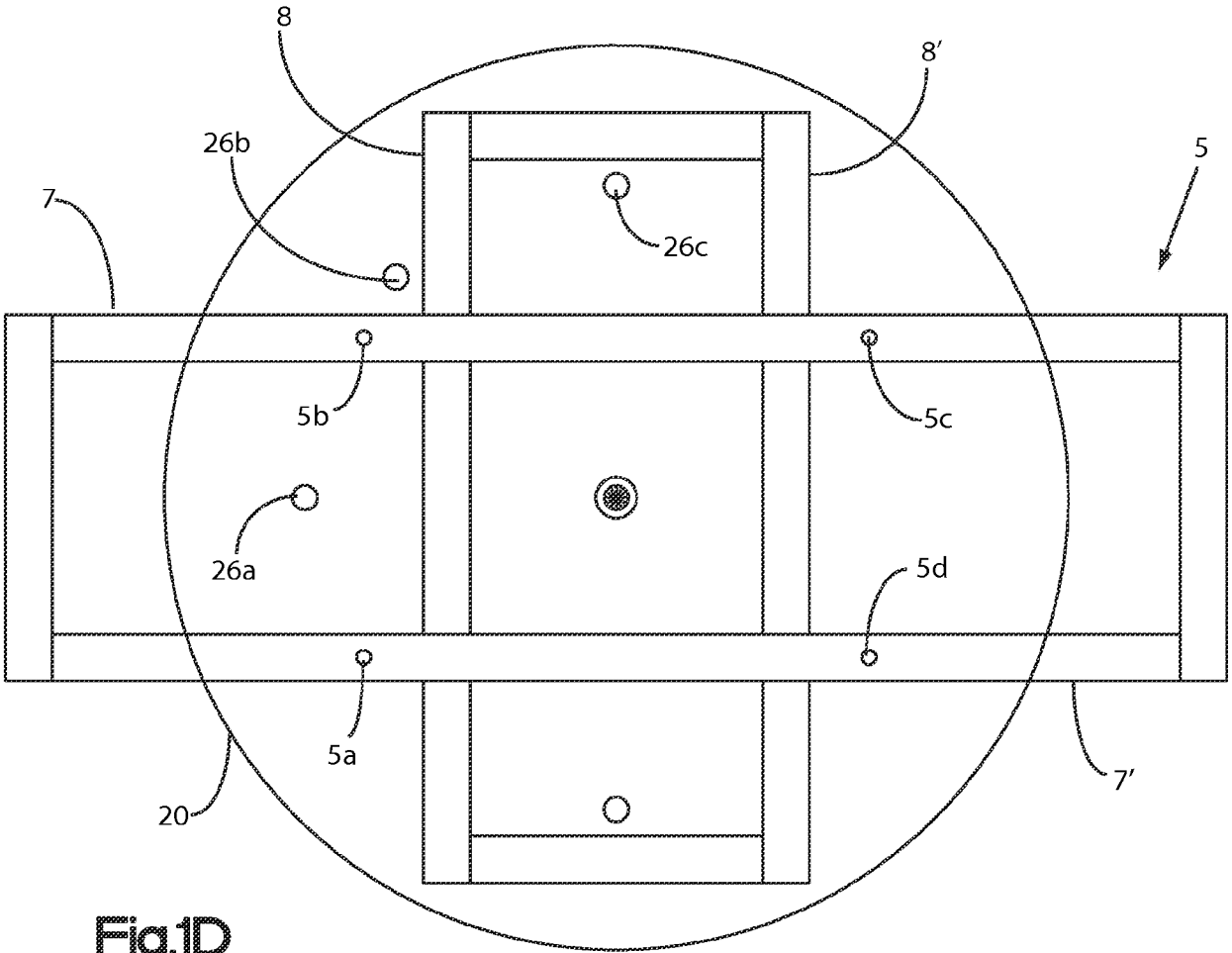

In a preferred embodiment, a first locking device 26 may be included to prevent the platform 20 from rotating on the base frame 5. Preferably, as shown in FIG. 1D, a series of holes 5*a*-5*d* designed to receive a pin are formed at various positions on the beams 7 of the base frame 5. Additionally, the platform 20 preferably includes one or more spring-loaded pin mechanisms 26*a-c* positioned to selectably mate with one of the holes 5*a* of the base frame 5 to lock the platform 20 in a desired position. In a preferred embodiment, base frame 5 includes at least two holes to permit the platform 20 to be positioned alternatively as shown in FIGS. 1 and 2. It is more preferred, however, that the platform 20 include at least three (3) pin mechanisms 26*a-c* and base frame 5 includes at least four (4) holes 5*a-d* to accommodate the platform 20 in positions angled every 45-degrees (i.e., 0°, 45°, 90°, 135°, 180°, 225°, 270°, 315°, and 360°. Persons of skill in the art will recognize that the number of holes and pin mechanisms is a matter of design choice.

A track 40 is mounted to the upper surface 21 of the platform 20. The track 40 generally comprises a pair of curved track portions 41, 42, which extend away from the upper surface 21 of the platform 20 such that the curved surface 41*a*, 42*a* of the track portions 41, 42 faces away from the platform 20. The track portions 41, 42 can be attached to one another by a pair of cross-braces 43, 43' mounted at each end of the respective track portions 41, 42. In a preferred embodiment, an inner surface 41*b*, 42*b* of each track portion 41, 42 preferably includes a channel 41*b*-1, 42*b*-1 that substantially follows the curve 41*a*, 42*a* of the track portions. The channels 41*b*-1, 42*b*-1 preferably terminate at a distance away from the end of the track portions 41, 42 to limit the range of motion within the track portion 41, 42, as will be described in further detail below.

Figure 4A:
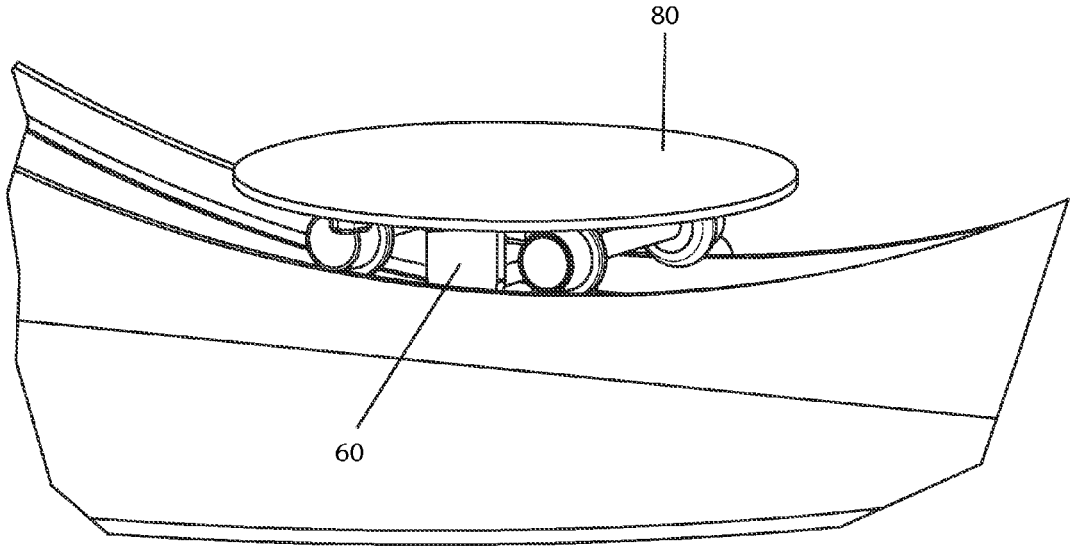
FIGS. 4A and 4B schematically illustrate views of a rolling mechanism and second platform positioned on the track mounted to the first platform in accordance with an embodiment of the present invention.
Figure 4B:
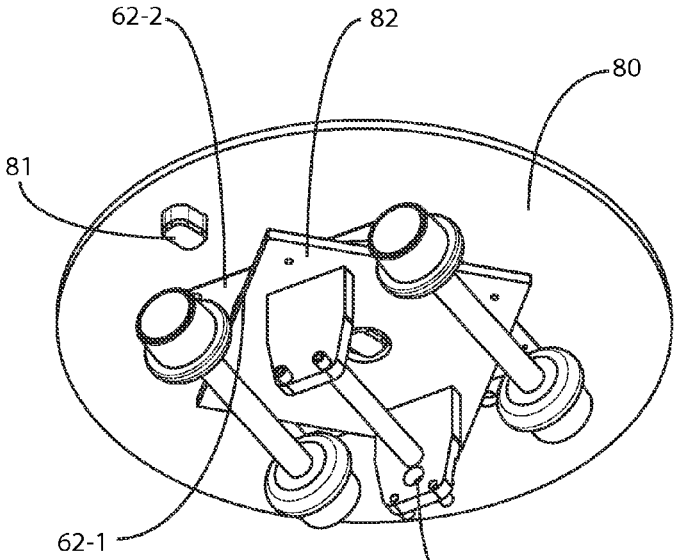

With reference again to FIGS. 1 and 2 and also to FIGS. 4A and 4B, a second selectably rotatable platform 80 is mounted to a rolling mechanism 60. In an embodiment, the connection between the bottom surface 81 of the second platform 80 and the rolling mechanism 60 is made via a turntable 62, which may include two movable sections (the first 62-1 attached to the rolling mechanism 60 and the second 62-2 attached to the bottom surface 81 of the second platform 80) separated by a low friction surface, such as may be produced by ball bearings. A second locking device 82 may be included to prevent the second platform 80 from rotating relative to the rolling mechanism 60. As noted above, the various locking combinations of first platform 20 and second platform 80 provide various exercise options.

Figure 5:
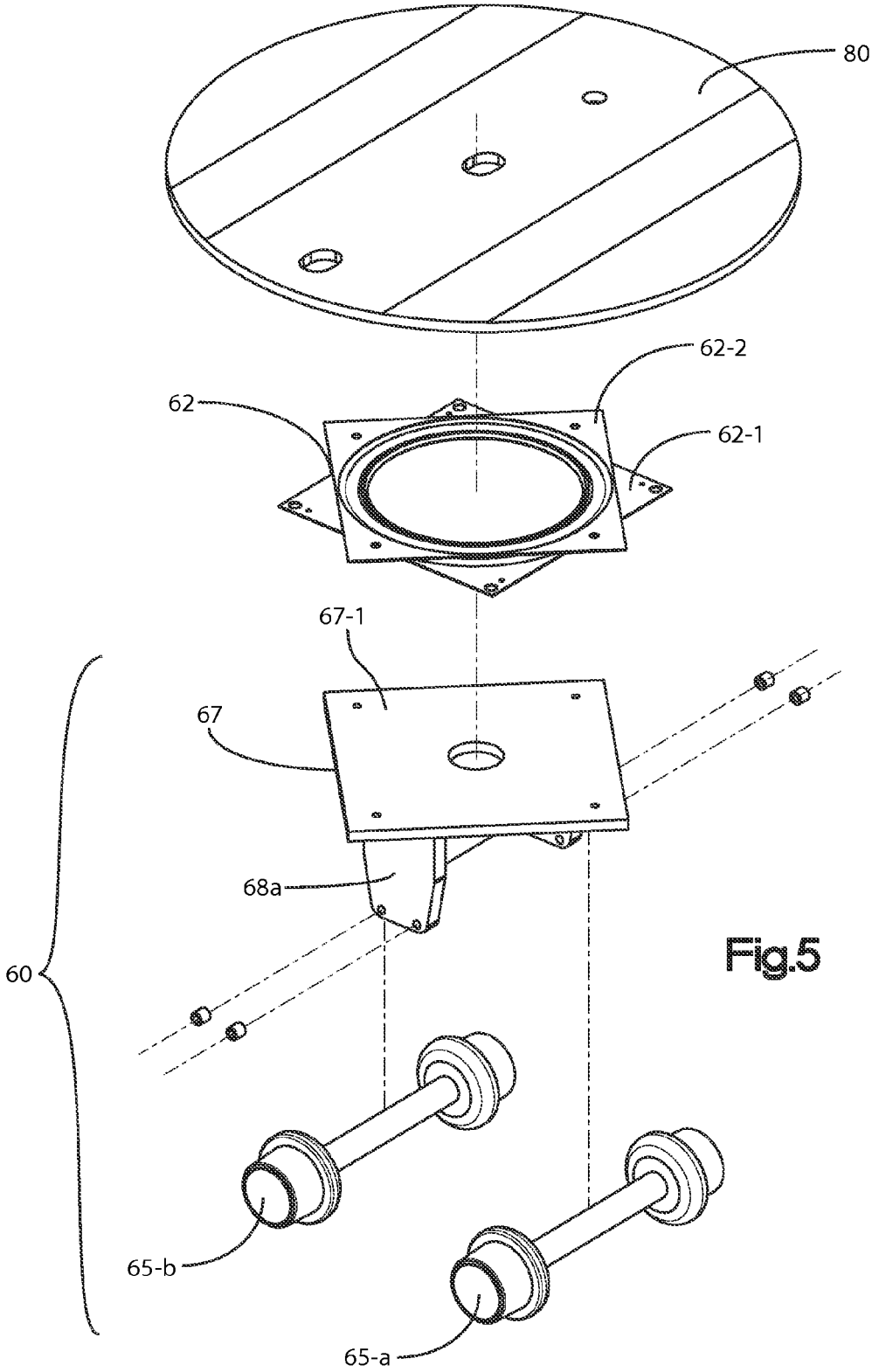
FIG. 5 schematically illustrates an exploded view of the rolling mechanism and second platform in accordance with an embodiment of the present invention.

With reference to FIG. 5, an exploded view of the platform 80 and rolling mechanism 60 are shown. The rolling mechanism 60 generally comprises two pairs of wheels 65*a*, 65*b* each mounted on an axle 66*a*, 66*b*, which is in turn mounted to a frame 67 of the rolling mechanism 60. The wheels 65*a*, 65*b* are spaced such that, when the rolling mechanism 60 is positioned on the curved surfaces 41*a*, 42*a* of the track portion 41, 42, the wheels 65*a*, 65*b* will ride on the curved surfaces 41*a*, 42*a*. The upper surface 67-1 of the frame 67 of the rolling mechanism 60 is mounted to the turntable 62 that mounts to the second platform 80 for providing the rotational functionality of the second platform 80. A pair of downwardly extending fins 68*a*, 68*b* extend from a bottom surface 67-2 of the frame 67 of the rolling mechanism 60, and are preferably positioned to extend downward and into the space between the inside walls 41*b*, 42*b* of the track portions 41, 42 when the rolling mechanism 60 is positioned on the track 40.

Figure 6:
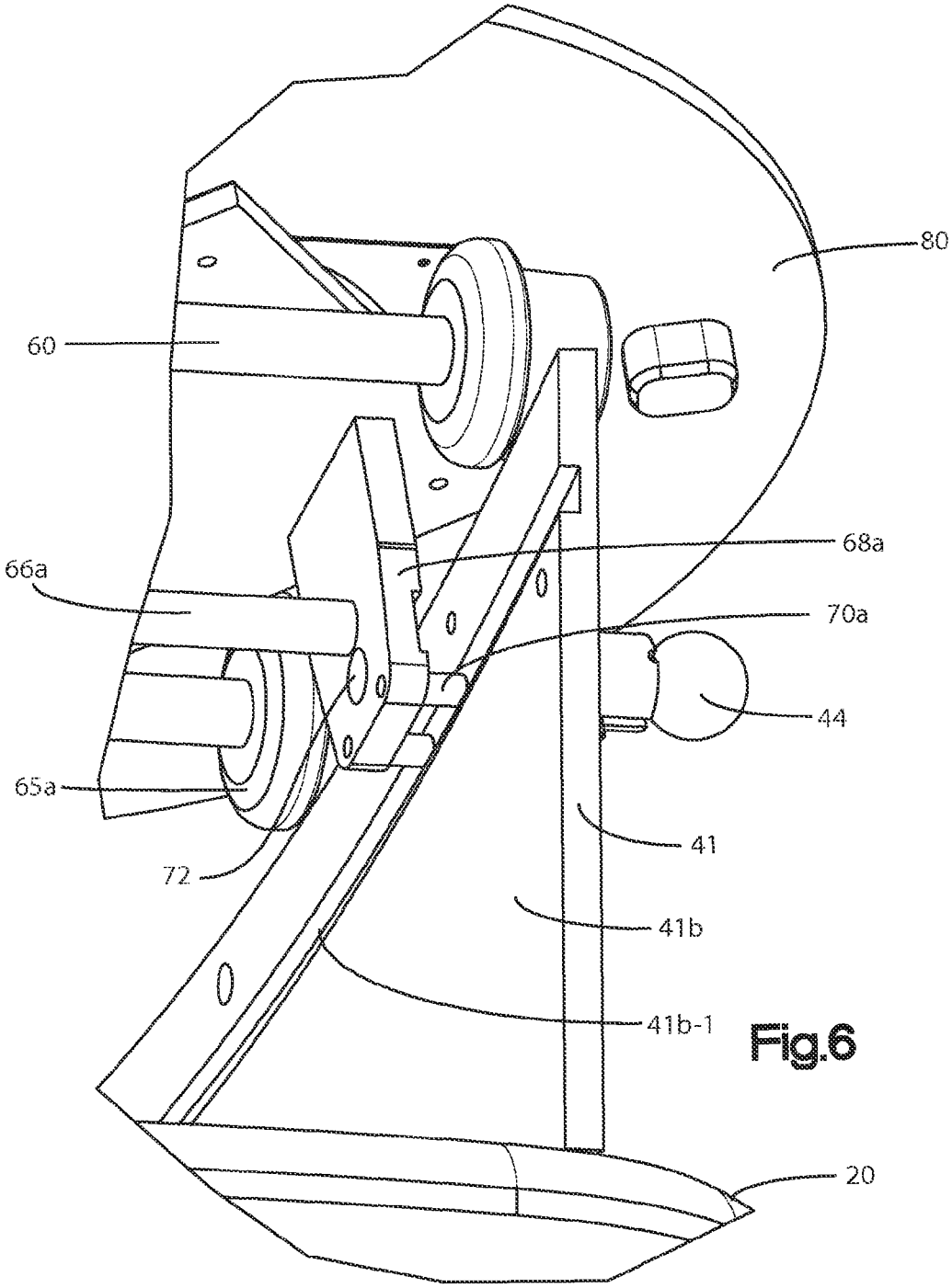
FIG. 6 depicts an underside view of the rolling mechanism slidably engaged with the curved track of the first platform in accordance with an embodiment of the present invention.

With further reference to FIG. 6, in one exemplary embodiment, at least one channel engagement portion 70*a*, 70*b* preferably extends from an outside face of each of the fins 68*a*, 68*b*. Each channel engagement portion 70*a*, 70*b* can be sized and configured to slidably engage the channels 41*b*-1, 42*b*-1 of the respective track portions 41, 42, such that when the rolling mechanism 60 is riding on the curved surfaces 41*a*, 42*a* of the track portions 41, 42 the channel engagement portions 70*a*, 70*b* will move within the channels 41*b*-1, 42*b*-1 to provide lateral support to the rolling mechanism 60. Multiple channel engagement portions 70*a*, 70*b* may be provided on the fins 68*a*, 68*b* to increase lateral support and prevent the rolling mechanism 60 from falling off of the track 40.

In an embodiment, a third locking device can lock the rolling mechanism, and thus the second platform, in a specified position on the track. As with the other locking devices this feature enables various customized exercises to be performed as further detailed above. As further shown in FIGS. 6 and 7, the pair of downwardly extending fins 68*a*, 68*b* extending from a bottom surface 67-2 of the frame 67 of the rolling mechanism 60 each preferably include a pin receiving hole 72, which is designed and configured to receive a spring mounted pin 44 fixed to at least one of the outer ends of at least one of the curved track portions 41, 42. The spring mounted pin 44 is preferably designed to selectably extend through one of the curved track portions 41, 42, so that it can engage the pin receiving hole 72 and fix the rolling mechanism 60, and thus the second platform 80 in a desired position on the curved track 41, 42. It will be understood by persons of skill in the art that more than one spring mounted pin 44 may be fixed on the curved track 41, 42 so as to permit the rolling mechanism 60 to be selectably position in various positions away from the center of the curved track 41, 42 to achieve various selectable training positions.

Figure 7:
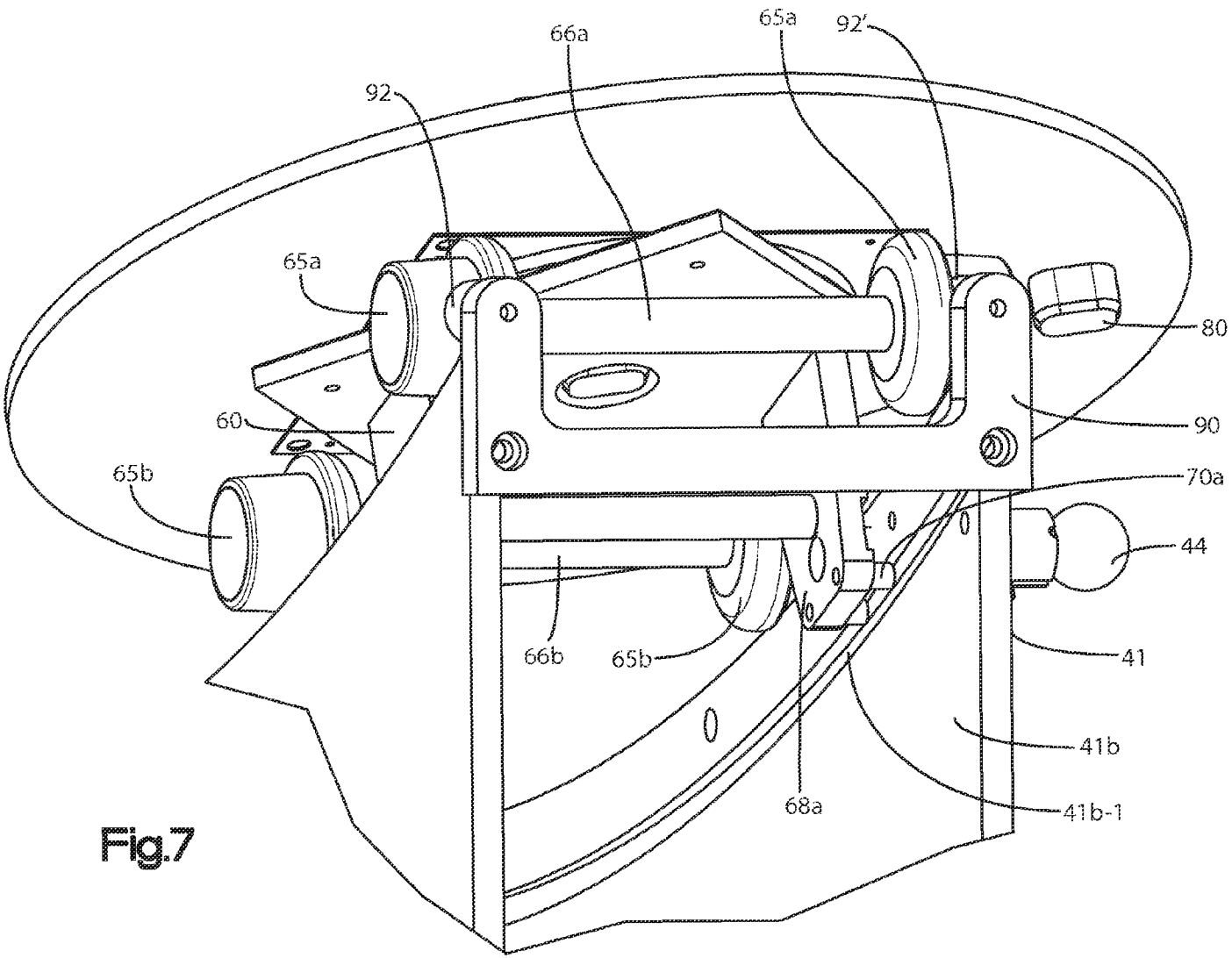
FIG. 7 depicts an underside view of the rolling mechanism in a lock position within the curved track of the first platform in accordance with an embodiment of the present invention.

In addition, as shown in FIGS. 6 and 7, an end plate 90, 90' is fixed to each end of the curved track 41, 42. The end plates 90, 90' preferably include a pair of rubber bumpers or stoppers 92, 92' facing inwardly towards a center of the exercise device 3 and aligned with the curved surfaces 41*a*, 42*a* of the track portions 41, 42. The function of the bumpers 92, 92' is to provide a backstop for the rolling mechanism 60 so that the second platform 80 cannot be overextended beyond the end of the curved track 41, 42. In lieu of a pair of bumpers 92, 92', one large bumper may be used.

The invention having been described in the foregoing, it will be apparent to those skilled in the art that many variations and/or changes can be made therein without departing from the nature and spirit of the invention, and all such changes and/or variations are intended to be included within the scope of the invention.

What is claimed is:

1. An exercise device, comprising:

a frame including a base frame and first and second posts extending substantially orthogonally from substantially outer ends of the base frame, the first and second posts each supporting an arm rest; a vertical reference axis substantially centrally located on said base frame;

a first platform rotatably connected to the base frame and selectably lockable in at least one position, the first platform including a curved track component mounted on an upper surface of the first platform such that a lowest point of the curved track component is substantially near a center of the first platform and a pair of high points are located substantially near an outer edge of the first platform;

a rolling mechanism designed and configured to ride on the curved track component;

and a second platform rotatably mounted to the rolling mechanism and selectably lockable in at least one position; said second platform having a generally flat upper surface for supporting both feet of a user, whereby said second platform can completely rotate about the vertical reference axis.

2. The exercise device of claim 1, wherein the curved track component further comprises a pair of curved track portions each of which extend away from the upper surface of the platform such that the curved surface of the track portions faces away from the platform.

3. The exercise device of claim 2, wherein the track portions can be attached to one another by a pair of cross-braces mounted at each end of the respective track portions.

4. The exercise device of claim 2, wherein an inner surface of each track portion includes a channel that substantially follows a curvature of the track portions.

5. The exercise device of claim 2, wherein a connection between a bottom surface of the second platform and the rolling mechanism is made via a turntable.

6. The exercise device of claim 2, wherein the rolling mechanism further comprises two pairs of wheels, a first pair of wheels mounted on a first axle and a second pair of wheel mounted on a second axle, wherein the first and second axles are mounted to a frame of the rolling mechanism.

7. The exercise device of claim 6, wherein the wheels of each of the two pairs of wheels are spaced such that, when the rolling mechanism is positioned on the curved surfaces of the track portion, the wheels will ride on the curved surfaces.

8. The exercise device of claim 4, wherein the rolling mechanism further comprises a pair of downwardly extending fins extending from a bottom surface of a frame of the rolling mechanism, and wherein the downwardly extending fins are positioned to extend downward and into the space between inside walls of the track portions when the rolling mechanism is positioned on the curved track component.

9. The exercise device of claim 8, wherein at least one channel engagement portion extends from an outside face of each of the fins and wherein each channel engagement portion is sized and configured to slidably engage the channels of the respective track portions, such that when the rolling mechanism is riding on the curved surfaces of the track portions the channel engagement portions will move within the channels to provide lateral support to the rolling mechanism.

10. A method of exercising, comprising:

providing an exercise device having multiple ranges of motion wherein the exercise device includes first and second selectably rotatable platforms, said second platform having a generally flat upper surface for supporting both feet of a user, wherein the second rotatable platform rides on a selectably lockable rolling mechanism, and wherein the rolling mechanism rides on a curved track mounted on the first rotatable platform;

providing a first locking mechanism to lock the position of the first platform, a second locking mechanism to lock the position of the second platform, and a third locking mechanism to lock the position of the rolling mechanism;

selectively locking one of the first, second, or third locking mechanisms;

and performing an abdominal workout on the exercise device to target a selected muscle group.

11. The method of claim 10, further comprising:

locking the first platform in a first position that positions a curved track mounted to the first platform and on which the rolling mechanism rides to extend in front of and behind a user; and locking the second platform so that it cannot rotate;

wherein the user is provided with a front to back movement along the curved track intended to target the anterior abdominal muscles as well as the back muscles (the rectus abdominus muscle).

12. The method of claim 10, further comprising:

locking the first platform in a second position that positions a curved track mounted to the first platform and on which the rolling mechanism rides to extend to the left and right of a user; and locking the second platform so that it cannot rotate;

wherein the user is provided with a side to side movement along the curved track intended to target the lateral part of the abdominal wall, the external oblique, the internal oblique and the transversus abdominus muscles.

13. The method of claim 10, further comprising:

locking the rolling mechanism in a third position that positions the rolling mechanism at a distance from a center of the exercise device;

wherein the user is provided with a revolving movement around the center intended to target the muscles of the torso.

* * * * *